US005489094A

United States Patent [19]

Pritchett

[11] Patent Number: 5,489,094

[45] Date of Patent: Feb. 6, 1996

[54] HEADS FOR GOLF CLUBS

[76] Inventor: Ronnie S. Pritchett, 41-875 Largo St., Palm Desert, Calif. 92260

[21] Appl. No.: 277,606

[22] Filed: Jul. 20, 1994

[51] Int. Cl.[6] ..... A63B 53/04

[52] U.S. Cl. ..... 273/78; 273/167 J; 273/173

[58] Field of Search ..... 273/167 R, 167 B, 273/167 D, 167 E, 167 F, 167 H, 167 J, 168, 169, 170, 171, 172, 173, 174, 175, DIG. 7, DIG. 23, 78

[56] References Cited

U.S. PATENT DOCUMENTS

| | | | |
|---|---|---|---|
| 1,094,599 | 4/1914 | Samson | 273/78 |
| 1,361,258 | 12/1920 | Horton | 273/173 |
| 1,485,685 | 3/1924 | McMahon | 273/173 |
| 2,756,055 | 7/1956 | Bittner | 273/173 |
| 3,172,667 | 3/1965 | Baker | 273/173 |
| 4,812,187 | 3/1989 | Honma | 273/167 J |
| 4,883,275 | 11/1989 | Boone | 273/167 H |
| 5,100,144 | 3/1992 | Okumoto | 273/167 J |
| 5,176,384 | 1/1993 | Sata | 273/173 |
| 5,198,062 | 3/1993 | Chen | 273/173 |

FOREIGN PATENT DOCUMENTS

| | | | |
|---|---|---|---|
| 211781 | 12/1957 | United Kingdom | 273/167 F |
| 2124910 | 2/1984 | United Kingdom | 273/167 J |

*Primary Examiner*—Sebastiano Passaniti
*Attorney, Agent, or Firm*—John Lezdey

[57] ABSTRACT

The invention provides a golf clubhead having a striking face that comprises at least two different materials so that a golf ball striking either material will give forth a different sound and feel such that the players will know when they have addressed the ball properly. In another embodiment of the invention, the striking face is divided into three portions called the toe, center and heel moving horizontally across the face wherein the center portion consists of a material that is of a different hardness than the material used in the toe and heel portions.

8 Claims, 1 Drawing Sheet

HEADS FOR GOLF CLUBS

FIELD OF THE INVENTION

The present invention relates to golf clubs and more particularly to heads for golf clubs having an advantageous construction.

BACKGROUND OF THE INVENTION

Almost all the heads of golf clubs and putters sold today have a geometrically unsymmetrical shape and/or are affixed in an offset relationship to the longitudinal center of their respective club shafts. In order to accurately hit a golf ball and obtain a maximum distance of flight, it is necessary to address the ball at substantially the center of gravity of the club head, which is substantially the geometric center of the blade. For this reason, it is customary in the manufacture of golf clubs to mark the striking face to indicate the center of gravity of the club. This area is commonly called the "sweet spot" or the center portion of the striking face. Moving horizontally along the striking face, the sweet spot is sandwiched between the heel and toe portions of the face.

The marking of the sweet spot offers the golf player a visual sight to focus on to help the player hit the golf ball with the sweet spot of the clubhead. However, such markings are of dubious value because the player cannot well concentrate his attention upon both the center of the ball and the markings of the clubhead.

If the ball is not addressed properly, that is, if the ball hits the heel or toe portions of the striking face, it will hook or slice and travel a distance less than its maximum potential. Since, the object of golf is to reach the hole in the minimum number of shots, such a 'mis-hit' would be disadvantageous to the player.

The present invention seeks to solve these problems by providing a "sound and feel" mechanism that is superior to a visual aid mechanism in helping the golfer to properly address the ball. In particular, the present invention modifies the composition of the striking face of the clubhead so that it comprises at least two portions or zones having different degrees of hardness and produces different sounds when struck against the ball. In another embodiment of the invention, the heel and toe portions are made out of metal, while the center portion or sweet spot is made out of a material that is of a different hardness than the metal on either side of it, like fiber glass for example. Such is the clubhead preferred by professional golfers. A beginner is likely to prefer the center portion to be harder so that mis-hits would not travel far.

Hardness is a "[p]roperty of substances determined by their ability to abrade or indent one another." See CRC Handbook of Chemistry and Physics (65th Ed. 1984–85) at F-84, which is incorporated herein by reference. Hardness of a material may be measured by any commonly recognized scientific scale. Two of the most common scales are the MOH values and the KNOOP values. Id. at F-19 and B-198-202.

The original MOH scale runs from 1 to 10 where the higher numbers correspond to the harder materials. For example, Talc, which is very soft, has a MOH value of 1, while diamond, which is universally known as very hard, has a 10 rating on the MOH scale. The following table contains the MOH values for some representative materials:

| HARDNESS OF MATERIALS | MOH VALUE (Original Scale) |
|---|---|
| Graphite | 0.5–1 |
| Talc | 1 |
| Lead | 1.5 |
| Tin | 1.5–1.8 |
| Aluminum | 2–2.9 |
| Copper | 2.5–3 |
| Ross' Metal | 2.5–3 |
| Wood's Metal | 3 |
| Brass | 3–4 |
| Bell-Metal | 4 |
| Glass | 4.5–6.5 |
| Steel | 5–8.5 |
| Carbon | 10 |
| Diamond | 10 |

It is apparent from the table that different kinds of metal have different MOH values. Thus, the invention also contemplates an all-metal club using at least two different kinds of metal, or alloys thereof.

SUMMARY OF THE INVENTION

The invention lies in the different properties inherent in the different zones of the striking face, for example, fiber glass versus those in the metal. More particularly, it is the difference in hardness between the center portion and the heel and toe portions that provide the "sound and feel" advantages of the present invention. First, the golfer can hear the difference between a good hit and a 'mis-hit' of the ball because a ball striking for example, a metal portion will impart a different pitch than when it strikes the fiberglass or other different material in the center portion.

Second, the golfer can feel the difference between a good hit and a 'mis-hit' of the ball because a ball striking the metal will impart a different vibration than when it strikes the fiberglass or other hard or less hard material in the middle.

Third, the present invention will also minimize the harm of a 'mis-hit'. Striking the metal portions adjacent to the sweet-spot will cause the ball to spin less. Consequently, a 'mis-hit' is less apt to go farther askew.

Fourth, the present invention can also be used as a training club to improve one's golf game. The preferred embodiment detailed herein shows the advantages provided for by the present invention and explains the training value of such a club. But, more importantly, the present invention has been designed in compliance with the Professional Rules of Golf by the Royal and Ancient Golf Club of St. Andrews and the United States Golf Association (USGA). See Rule 2 and Appendix II USGA Revised Re-Drafts (Sep. 11, 1981), which are incorporated herein by reference. Therefore, the golf club of the present invention may be used during tournament play while still providing the player with constant training.

The construction of the club must not deviate too much from the traditional and customary form. The rules require that the club face be harder and more rigid than the ball. This prevents the club face from acting like a spring at impact, which could unduly influence the movement of the ball. Moreover, no foreign material may be added to the club face which could unduly influence the movement of the ball. The clubhead should be plain in shape without any fins or holes. Furrows or runners may not extend into the face except for certain kinds of golf putters. If there is any doubt as to the legality of any newly constructed golf club, the manufacturer should consult the Royal and Ancient Golf Club of St. Andrews or the USGA.

The construction of the present invention complies with all the USGA rules and may be used in tournaments conducted pursuant to sponsored or sanctioned by the USGA.

Accordingly, it is an objective of the present invention to overcome the difficulties experienced by golfers in addressing the ball properly.

In other words, the objective is to help the golfer become more proficient in hitting the ball with the sweet spot of the club head.

It is a further objective of the invention to assist the golfer in distinguishing between good hits and 'mis-hits' by the sound of each hit.

It is still a further objective of the invention to assist the golfer in distinguishing between good hits and 'mis-hits' by the feel of each hit.

It is a further objective of the invention to minimize the harm caused by a 'mis-hit'.

It is a further objective of the invention to provide a training tool to help improve the proficiency of the golfer hitting the ball with the sweet spot of the golf club.

It is still a further objective of the invention to provide a golf club that assists the golfer in hitting the ball with the sweet spot of the golf club and is manufactured within the specifications required by the Professional Rules of Golf.

Other objects and advantages will become more apparent from the following detailed description of the preferred embodiments and the accompanying drawing.

In order to drive the ball in the proper direction and secure the longest possible flight, it is necessary to strike the ball with the portion of the blade known as the sweet spot. This spot usually coincides with the geometric center or the center of gravity of the clubhead and is also called the center portion of the striking face.

Figure 1:
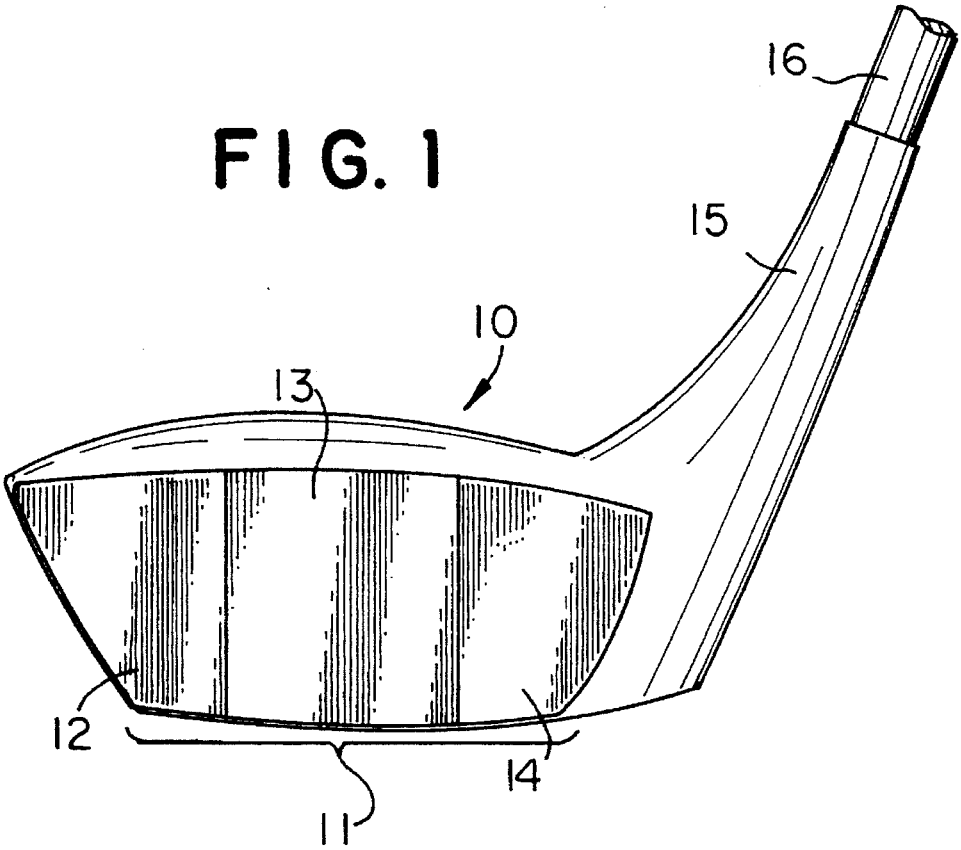
FIG. 1 is a side elevational view illustrating a preferred embodiment of the present invention.

As FIG. 1 shows, a golf clubhead 10 is provided with a striking face 11 which is divided into three portions moving horizontally across the front of the clubhead 10, namely the toe 12, center 13, and heel 14 portions. The toe 12 and heel 14 portions consist of metal. The center 13 portion comprises a material that is of lesser hardness than the metal used in the toe 12 and heel 14 portions. The shaft 16 is connected to the clubhead through a shank 15 portion.

The most preferred material for the center 13 portion is fiberglass. Moreover, the center portion 13 may also comprise a metal or polymer that is different and less hard than the type of metal used in the toe 12 and heel 14 portions for use by the more proficient golfers. It is however understood that a harder center portion may be preferred by others.

In another embodiment of the invention, a metal sole plate on the bottom of said clubhead is connected to the metal toe and heel portions on the striking face of said clubhead.

In another embodiment of the invention, plates on either side of the head, other than the composition of the striking face, is made out of solid wood.

In yet another embodiment of the invention, the solid wood head with the invention's striking face is laminated to persimmon wood.

Figure 2:
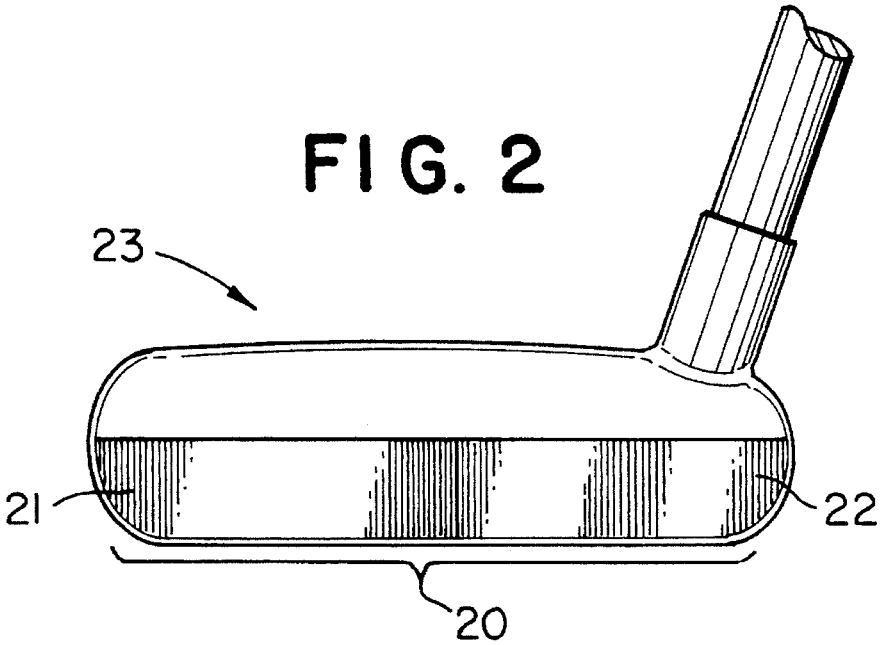
FIG. 2 is a side elevational view illustrating another embodiment of the present invention.

In yet another embodiment of the invention, as illustrated in FIG. 2, a golf clubhead 23 is provided with a striking face 20, which is divided into only two portions 21 and 22 having different degrees of hardness.

Advantageously, at least one portion of the striking face is wood or fiberglass. Preferably, the striking face about the toe portion comprises metal.

It is understood that the various components which are conventionally used for the striking face of golf clubheads can form a component in the present invention. Some of such components include fiberglass, polycarbonate, polyurethane, wood, steel, etc.

As various changes may be made in the form, arrangement and construction of parts of the preferred embodiments without departing from the spirit of the invention, it will be understood that all matters herein is to be taken as illustrative and not in a limiting sense.

What is claimed:

1. A solid wood golf clubhead comprising a striking head and a shank portion for attachment to a shaft, said striking head including a striking face having at least three striking portions of different hardnesses; said striking portions consisting of a toe portion, a center portion and a heel portion, said toe and heel portions comprising a metallic material, and said center portion comprising a non-metallic material having a lesser degree of hardness than said metallic toe and heel portions.

2. The golf clubhead of claim 1, wherein said center portion comprises a material selected from the group consisting of wood and fiberglass.

3. The golf clubhead of claim 1, wherein said solid wood clubhead comprises persimmon wood.

4. In a solid wooden golf clubhead having a striking face, the improvement comprising said striking face having at least three striking portions of different hardnesses; said striking portions consisting of a toe portion, a center portion and a heel portion; said center portion being non-metallic; and said toe and heel portions being metallic; wherein each portion gives off a different sound and feel upon impact with a golf ball.

5. The golf clubhead of claim 4, wherein said center portion has a lesser degree of hardness than said metallic toe and heel portions.

6. The golf clubhead of claim 4, further comprising a metal sole plate on the bottom of said clubhead which is connected to said toe and heel portions on the striking face of said clubhead.

7. The golf clubhead of claim 4, wherein said solid wood clubhead comprises persimmon wood.

8. The golf clubhead of claim 4, wherein said center portion comprises a material selected from the group consisting of wood and fiberglass.

* * * * *